US011021882B2

(12) United States Patent
Martz

(10) Patent No.: US 11,021,882 B2
(45) Date of Patent: Jun. 1, 2021

(54) BLADED TOOL WITH ADJUSTABLE VEE ANGLE

(71) Applicant: Bruce D. Martz, Chesapeake, VA (US)

(72) Inventor: Bruce D. Martz, Chesapeake, VA (US)

( * ) Notice: Subject to any disclaimer, the term of this patent is extended or adjusted under 35 U.S.C. 154(b) by 38 days.

(21) Appl. No.: 16/550,661

(22) Filed: Aug. 26, 2019

(65) Prior Publication Data

US 2020/0087931 A1 Mar. 19, 2020

Related U.S. Application Data

(60) Provisional application No. 62/724,453, filed on Aug. 29, 2018.

(51) Int. Cl.
*E04F 21/165* (2006.01)
*E04F 21/16* (2006.01)

(52) U.S. Cl.
CPC ..... *E04F 21/1655* (2013.01); *E04F 21/161* (2013.01)

(58) Field of Classification Search
CPC . E04F 21/165; E04F 21/1652; E04F 21/1655; E04F 21/161; B05C 17/10
USPC ..... 15/235.7, 235.8; 425/87, 458
See application file for complete search history.

(56) References Cited

U.S. PATENT DOCUMENTS 5,115,536 A * 5/1992 Jarvis ..... B25G 3/38 15/144.1
5,792,489 A * 8/1998 Liberman ..... E04F 21/1655 15/235.7
2019/0360218 A1* 11/2019 Stubbs ..... E04F 21/1655

* cited by examiner

*Primary Examiner* — Laura C Guidotti
*Assistant Examiner* — Thomas Raymond Rodgers
(74) *Attorney, Agent, or Firm* — William G. Sykes

(57) ABSTRACT

A tool having two adjacent blades, for working fluent materials such as cement, plaster, and epoxies in corners and other angled areas, is shown and described. Each blade is angularly adjustable with respect to an included angle defined between the two blades. The tool may have right and left blade portions pivotal along abutting or adjacent edges, and a linkage including a releasable clamp to establish and secure desired working angles between the right and left blade portions. The tool has two pivot axles, one for supporting each of the right and left blade portions.

9 Claims, 2 Drawing Sheets

BLADED TOOL WITH ADJUSTABLE VEE ANGLE

RELATED APPLICATIONS

This application claims priority in accordance with 37 CF.R. ¶1.19(e) to U.S. Provisional Patent Application Ser. No. 62/724,453 filed for BLADED TOOL WITH ADJUSTABLE VEE ANGLE filed Aug. 29, 2018 which is included herein in its entirety by reference.

FIELD OF THE INVENTION

The present invention relates to tools such as trowels, scrapers, and other smoothing and shaping tools for working fluent materials such as plaster and cement, where it is desirable to have two adjacent blade sections arranged at an acute or obtuse angle to one another.

BACKGROUND OF THE INVENTION

When working cement and plaster in buildings for example, it is occasionally necessary to perform the work in corners in locations having limited access. In such circumstances, it may be desirable to smooth, deposit, remove, or recontour the fluent material simultaneously at two surfaces oriented at an acute or obtuse angle to one another. A tool having a corresponding angle in its blade would be ideal. However, in different work sites, the angle may vary and not be predictable. Hence a tool having an adjustable angle is needed to provide one tool capable of working at diverse blade angles.

SUMMARY OF THE INVENTION

The present invention meets the above need by providing a tool having two adjacent blades, each blade being angularly adjustable. To this end, the tool may have right and left blade portions pivotal along abutting or adjacent edges, and a linkage including a releasable clamp to establish and secure desired working angles between the right and left blade portions.

In one aspect of the invention, the tool has two pivot axles, one for each of the right and left blade portions. This enables each of the right and left blade portions to encircle its respective pivot axle along the full length of the pivot axle. This has the advantage of avoiding a conventional piano hinge, wherein each of the right and left blade portions would have tabs interleaved with tabs of the other blade portion. Among other advantages, this construction eliminates many potential entry areas of the material being worked to enter and foul the hinge. Entry of the worked material could immobilize one or both of the blade sections in one position, thereby overcoming adjustability. This is a hazard of cementitious materials, and also of synthetic harden able materials such as for example epoxy based bonding materials and permanently pliable materials such as silicone for example, which may be used in aircraft bodies, boat bodies, and other constructions based on for example fiberglass.

Also, even if the material did not immobilize the blade sections, materials such as cement may be objectionably abrasive. Exclusion of an abrasive material may prolong the useful life of the tool as undue wear and consequent slop or play of one or both of the blade sections could develop with infiltration of the worked material into a piano hinge joint.

The present invention provides improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
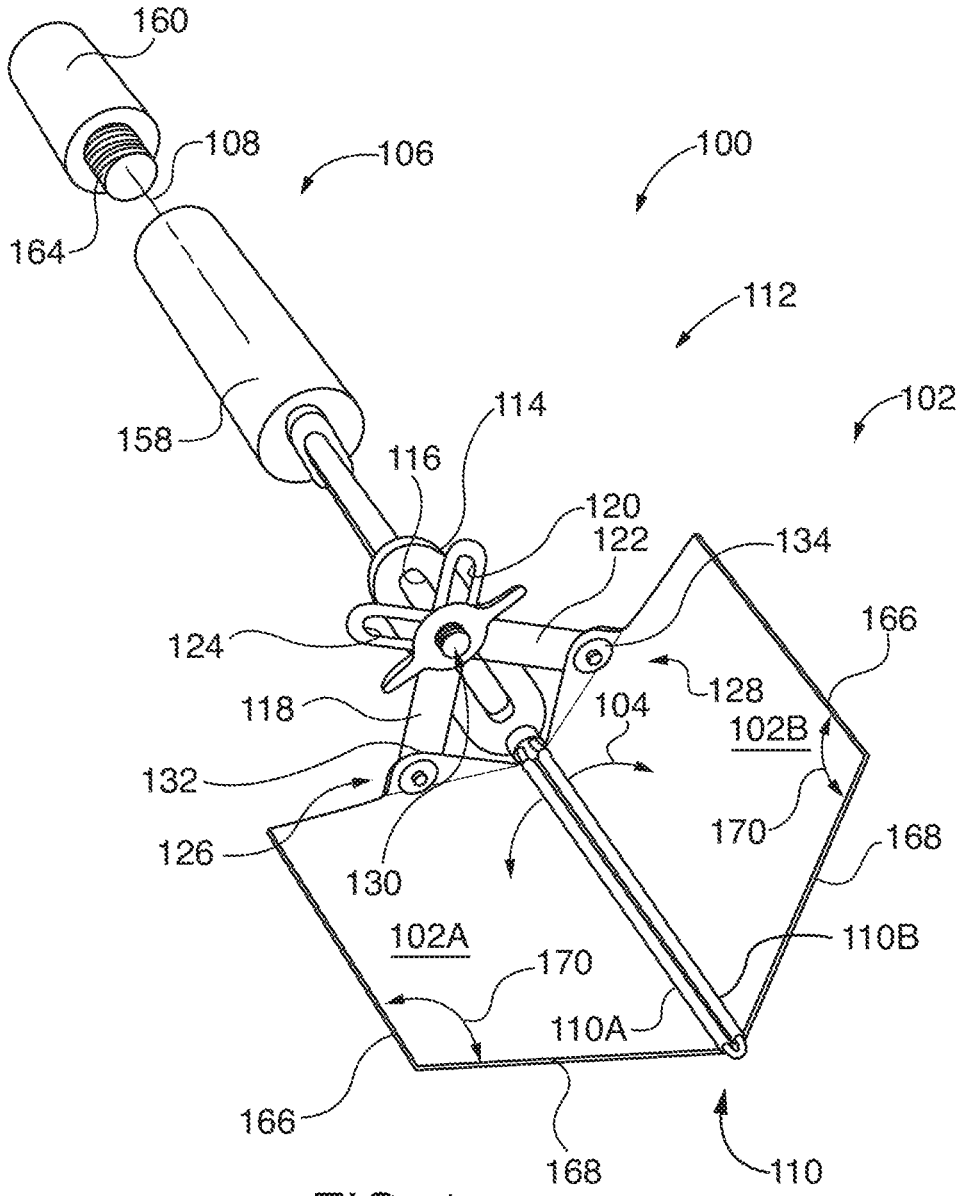
FIG. 1 is a front perspective view of a tool according to at least one aspect of the invention.
Figure 2:
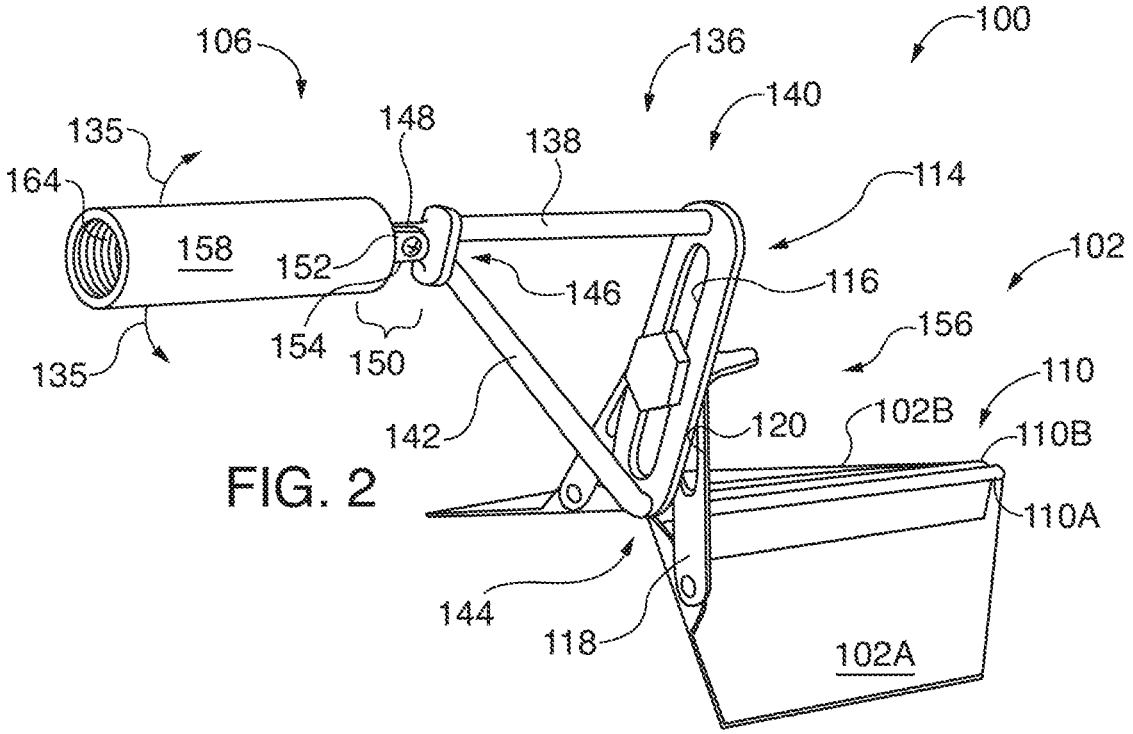
FIG. 2 is a side perspective view of the tool of FIG. 1.
Figure 2A:
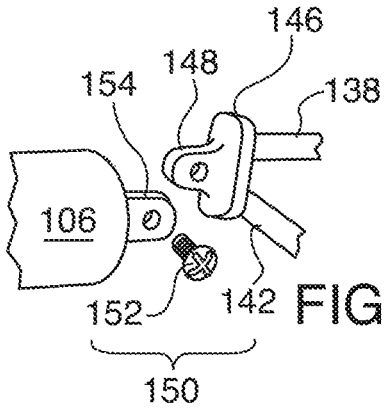
FIG. 2*a* is a detail drawing of the handle connector.

Referring now to FIGS. 1 and 2, according to at least one aspect of the invention, there is shown a tool 100 having a blade 102 providing an adjustable vee angle 104. Tool 100 comprises a handle 106 comprising a handle longitudinal axis 108, two-part blade 102 including a right blade portion 102A and a left blade portion 102B. A dual hinge axle 110 includes a right axle portion 110A pivotally supporting and guiding right blade portion 102A and an adjacent left axle portion 110B pivotally supporting and guiding left blade portion 102B. Tool 100 comprises a linkage 112 enabling adjustment of vee angle 104 between right blade portion 102A and left blade portion 102B.

Providing dual hinge axle 110 as having right and left axle portions 110A, 110B enables elimination of a piano hinge construction while still providing effective bearing and guidance of right and left blade portions 102A, 102B.

Right and left axle portions 110A, 110B are parallel to one another and spaced apart just enough to allow for thickness of those portions of respective right and left blade portions 102A, 102B to wrap snugly around right and left portions 110A, 110B, and to leave a slight gap to prevent right and left blade portions 102A, 102B from rubbing against one another.

It should be noted at this point that orientational terms such as right and left are used for semantic purposes to distinguish one element from a second, similar element. Therefore, orientational terms must be understood to provide semantic basis for purposes of description, do not necessarily apply to their literally construed meanings, and do not limit the invention or its component parts in any particular way.

Linkage 112 includes a main slotted arm 114 fixed to handle 106. Main slotted arm 114 includes a longitudinal slot 116 extending centrally there along. A right side slotted connecting arm 118 spans main slotted arm 114 and right blade portion 102A. Right side slotted connecting arm 118 includes a longitudinal slot 120 extending centrally there along. A left side slotted connecting arm 122 spans main slotted arm 114 and left blade portion 102B. Left side slotted connecting arm 122 includes a longitudinal slot 124 extending centrally there along. A right-side pivot joint 126 pivotally connects right side blade portion 102A and right side slotted connecting arm 118. A left side pivot joint 128 pivotally connect left side blade portion 102B and left side slotted connecting arm 122.

This arrangement of right and left slotted connecting arms 118, 122 and main slotted arm 114 provides a large number and range of adjustments of vee angle 104. When making the adjustment, a user (not shown) can grasp one right or left blade portion 102A or 102B and maneuver the same while leaving the other in a fixed position. Alternatively stated, it is not necessary to adjust both simultaneously. This allows for example one of right and left blade portions 102A, 102B to be placed against a work piece while the other is adjusted.

Tool 100 comprises a releasable clamp 130 releasably pinning both right side slotted connecting arm 118 and left side slotted connecting arm 122 to main slotted arm 114. Thus three elements (main slotted arm 114 and right and left side slotted connecting arms 118 and 122) may be fixed in place by one fastener.

In the embodiment of FIGS. 1 and 2, longitudinal slots 116, 120, 124 are formed within and along respective lengths of their associated arms 114, 118, 122. This further increases adjustment options.

Pivot joints 126, 128 and releasable clamp 130 may each comprise a threaded fastener extending through holes in their associated right and left side slotted connecting arms 118 and 122 and right and left blade portions 102A and 102B. More particularly, right side blade portion 102A may include a right tab 132 projecting perpendicularly therefrom, wherein right-side pivot joint 126 is anchored to right tab 132. Left side blade portion 102B may include a left tab 134 projecting perpendicularly therefrom, wherein left side pivot joint 128 is anchored to left tab 134. This construction enables releasable clamp 130 to comprise a threaded fastener such as a bolt and wing nut combination 156.

Best shown in FIG. 2, main slotted arm 114 may be part of a triangular structure 136 comprising main slotted arm 114, a first strut 138 fixed to one end 140 of main slotted arm 114, a second strut 142 fixed to an opposed end 144 of main slotted arm 114 and to first strut 138 at a juncture 146, and a tab 148 projecting from juncture 146 and coupled to handle 106. A triangle is a rigid, robust construction which resists collapse.

Unless otherwise indicated, the terms "first", "second", etc., are used herein merely as labels, and are not intended to impose ordinal, positional, or hierarchical requirements on the items to which these terms refer. Moreover, reference to, e.g., a "second" item does not either require or preclude the existence of, e.g., a "first" or lower-numbered item, and/or, e.g., a "third" or higher-numbered item.

Tab 148 may be fixedly coupled to handle 106, or alternatively, separably coupled to handle 106 as follows.

Tool 100 may further comprise an angularly adjustable joint 150 connecting tab 148 and handle 106, angularly adjustable joint 150 enabling adjustment of handle longitudinal axis 108 relative to dual hinge axle 110. This adjustment is indicated by arrows 135. Connection of angularly adjustable joint 150 is not direct; rather, triangular structure 136 is interposed therebetween. The adjustment enables a person to grasp handle 106 at orientations independent of orientation of blade 102 after adjustment is made and tightened.

Angularly adjustable joint 150 may comprise a threaded fastener 152 passing through tab 148 and handle 106. Threaded fastener 152 may comprise a bolt extending through a tab 154 fixed to and projecting from handle 106.

Handle 106 may comprise a permanent portion 158 fixed to linkage 112 and a detachable extension 160 detachably coupled to permanent portion 158. Coupling may be by turning a threaded stub 162 into threads 164 of permanent portion 158 for example.

Blade 102 may have a configuration wherein right blade portion 102A and left blade portion 102B each include a lateral edge 166 and a forward edge 168 arranged at an obtuse angle 170 to lateral edge 166.

Releasable clamp 130 or angularly adjustable joint 150 or both may be continuously adjustable, or alternatively, may additionally or exclusively have discrete detent positions.

Figure 3:
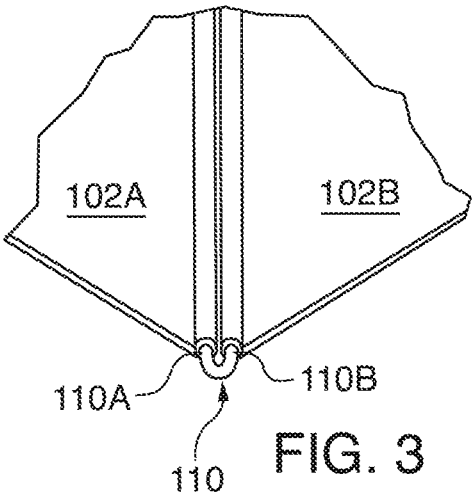
FIG. 3 is an enlarged detail view of the lower right of FIG. 1.
Figure 4:
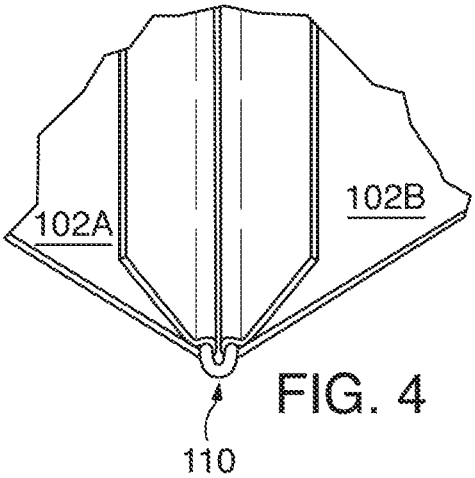
FIG. 4 corresponds to FIG. 3, but shows an alternative embodiment.

Referring particularly to FIG. 3, right and left blade portions 102A, 102B may be rolled as shown, terminating so as to just enclose right and left axle portions 110A, 110B of dual hinge axle 110. Alternatively, and turning to FIG. 4, right and left blade portions 102A, 102B may each be extended to include respective wings 172, 174 projecting from the rolled portions of right and left blade portions 102A, 102B. This option allows for enclosure of dual hinge axle 110 to be reinforced by wings 172, 174, the latter affording additional surface area for soldering, adhesives, or other bonding to secure that portion of right and left blade portions 102A, 102B encircling right and left axle portions 110A, 110B.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A tool having a blade providing an adjustable vee angle, the tool comprising:

a handle comprising a handle longitudinal axis;

a two part blade including a right blade portion and a left blade portion;

a dual hinge axle including a right axle portion pivotally supporting and guiding the right blade portion and an adjacent left axle portion pivotally supporting and guiding the left blade portion, wherein the left and right axle portions are of unitary construction formed with a bend resulting in right and left axle portions that are parallel and spaced apart from one another; and a linkage enabling adjustment of the vee angle between the right blade portion and the left blade portion.

2. The tool of claim 1, wherein the linkage includes a main slotted arm fixed to the handle, the main slotted arm including a longitudinal slot extending centrally there along;

a right side slotted connecting arm spanning the main slotted arm and the right blade portion, the right side slotted connecting arm including a longitudinal slot extending centrally there along;

a left side slotted connecting arm spanning the main slotted arm and the left blade portion, the left side slotted connecting arm including a longitudinal slot extending centrally there along;

a right side pivot joint pivotally connecting the right side blade portion and the right side slotted connecting arm;

a left side pivot joint pivotally connecting the left side blade portion and the left side slotted connecting arm; and a releasable clamp releasably pinning both the right side slotted connecting arm and the left side slotted connecting arm to the main slotted arm.

3. The tool of claim 2, wherein the right side blade portion includes a right tab projecting perpendicularly therefrom;

the right side pivot joint is anchored to the right tab;

the left side blade portion includes a left tab projecting perpendicularly therefrom; and the left side pivot joint is anchored to the left tab.

4. The tool of claim 3, wherein the main slotted arm is part of a triangular structure comprising the main slotted arm, a first strut fixed to one end of the main slotted arm, a second strut fixed to an opposed end of the main slotted arm and to the first strut at a juncture, and a tab projecting from the juncture and coupled to the handle.

5. The tool of claim 4, further comprising an angularly adjustable joint connecting the tab and the handle, the angularly adjustable joint enabling adjustment of the handle longitudinal axis relative to the dual hinge axle.

6. The tool of claim 5, wherein the angularly adjustable joint comprises a threaded fastener passing through the tab and the handle.

7. The tool of claim 2, wherein the releasable clamp comprises a threaded fastener.

8. The tool of claim 1, wherein the handle comprises a permanent portion fixed to the linkage and a detachable extension detachably coupled to the permanent portion.

9. The tool of claim 1, wherein the right blade portion and the left blade portion each include a lateral edge and a forward edge arranged at an obtuse angle to the lateral edge.

* * * * *